US006866013B2

(12) United States Patent
Smith

(10) Patent No.: US 6,866,013 B2
(45) Date of Patent: Mar. 15, 2005

(54) HYDRAULIC CUSHIONING OF A VARIABLE VALVE TIMING MECHANISM

(75) Inventor: Franklin R. Smith, Cortland, NY (US)

(73) Assignee: Borgwarner Inc., Auburn Hills, MI (US)

( * ) Notice: Subject to any disclaimer, the term of this patent is extended or adjusted under 35 U.S.C. 154(b) by 0 days.

(21) Appl. No.: 10/376,876

(22) Filed: Feb. 28, 2003

(65) Prior Publication Data

US 2003/0196624 A1 Oct. 23, 2003

Related U.S. Application Data

(60) Provisional application No. 60/374,241, filed on Apr. 19, 2002.

(51) Int. Cl.[7] ..... F01L 1/34

(52) U.S. Cl. ..... 123/90.17; 123/90.12; 123/90.16; 92/125; 464/160; 464/2

(58) Field of Search ..... 123/90.17, 90.12, 123/90.15–90.18, 90.31; 464/1, 2, 160; 91/177, 402–409; 92/67, 68, 69 R, 75, 120–126, 85, 13

(56) References Cited

U.S. PATENT DOCUMENTS

| | | | | | |
|---|---|---|---|---|---|
| 4,601,231 | A | * | 7/1986 | Shimoda | 91/26 |
| 4,858,572 | A | | 8/1989 | Shirai et al. | 123/90.12 |
| 5,002,023 | A | | 3/1991 | Butterfield et al. | 123/90.15 |
| 5,107,804 | A | | 4/1992 | Becker et al. | 123/90.17 |
| 5,172,659 | A | | 12/1992 | Butterfield et al. | 123/90.17 |
| 5,184,578 | A | | 2/1993 | Quinn, Jr. et al. | 123/90.17 |
| 5,289,805 | A | | 3/1994 | Quinn, Jr. et al. | 123/90.17 |
| 5,361,735 | A | | 11/1994 | Butterfield et al. | 123/90.17 |
| 5,497,738 | A | | 3/1996 | Siemon et al. | 123/90.17 |
| 5,657,725 | A | | 8/1997 | Butterfield et al. | 123/90.17 |
| 5,836,277 | A | | 11/1998 | Kira et al. | 123/90.17 |
| 5,979,380 | A | * | 11/1999 | Nakadouzono et al. | 123/90.17 |
| 6,062,182 | A | * | 5/2000 | Ogawa | 123/90.17 |
| 6,085,708 | A | | 7/2000 | Trzmiel et al. | 123/90.17 |
| 6,176,210 | B1 | * | 1/2001 | Lichti et al. | 123/90.17 |
| 6,247,434 | B1 | | 6/2001 | Simpson et al. | 123/90.17 |
| 6,250,265 | B1 | | 6/2001 | Simpson | 123/90.17 |
| 6,263,846 | B1 | | 7/2001 | Simpson et al. | 123/90.17 |
| 6,311,655 | B1 | | 11/2001 | Simpson et al. | 123/90.17 |
| 6,374,787 | B2 | | 4/2002 | Simpson et al. | 123/90.17 |
| 6,390,043 | B1 | | 5/2002 | Niethammer et al. | 123/90.17 |
| 2001/0022164 | A1 | | 9/2001 | Ogawa | 123/90.16 |

* cited by examiner

*Primary Examiner*—Thomas Denion
*Assistant Examiner*—Kyle Riddle
(74) *Attorney, Agent, or Firm*—Brown & Michaels, PC; Greg Dziegielewski

(57) ABSTRACT

A variable camshaft timing mechanisms having a vane/housing format is provided. Working hydraulic chambers are created by imposing either single or multiple vanes of a rotor attached to the camshaft into a cavity in a housing that is attached to the camshaft sprocket. Fluid is allowed to normally exhaust from the hydraulic chamber during normal phasing until the rotor nears the end of its travel.

3 Claims, 5 Drawing Sheets

HYDRAULIC CUSHIONING OF A VARIABLE VALVE TIMING MECHANISM

REFERENCE TO RELATED APPLICATIONS

This application claims an invention which was disclosed in Provisional Application No. 60/374,241, filed Apr. 19, 2002, entitled "Hydraulic Cushioning of a Variable Valve Timing Mechanism". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of variable valve timing (VCT) systems. More particularly, the invention pertains to a VCT mechanism having hydraulic cushioning.

2. Description of Related Art

The performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft powered chain drive or belt drive. Engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft.

Consideration of information disclosed by the following U.S. Patents, which are all hereby incorporated by reference, is useful when exploring the background of the present invention.

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position on of a camshaft relative to a crankshaft. The control system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure, $P_C$, on one end of the spool and the relationship between the hydraulic force on such end and an oppositely direct mechanical force on the other end which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

U.S. Pat. Nos. 5,172,659 and 5,184,578 both address the problems of the aforementioned types of VCT systems created by the attempt to balance the hydraulic force exerted against one end of the spool and the mechanical force exerted against the other end. The improved control system disclosed in both U.S. Pat. Nos. 5,172,659 and 5,184,578 utilizes hydraulic force on both ends of the spool. The hydraulic force on one end results from the directly applied hydraulic fluid from the engine oil gallery at full hydraulic pressure, $P_S$. The hydraulic force on the other end of the spool results from a hydraulic cylinder or other force multiplier which acts thereon in response to system hydraulic fluid at reduced pressure, $P_C$, from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool.

U.S. Pat. No. 5,289,805 provides an improved VCT method which utilizes a hydraulic PWM spool position control and an advanced control algorithm that yields a prescribed set point tracking behavior with a high degree of robustness.

In U.S Pat. No. 5,361,735, a camshaft has a vane secured to an end for non-oscillating rotation. The camshaft also carries a timing belt driven pulley which can rotate with the camshaft but which is oscillatable with respect to the camshaft. The vane has opposed lobes which are received in opposed recesses, respectively, of the pulley. The camshaft tends to change in reaction to torque pulses which it experiences during its normal operation and it is permitted to advance or retard by selectively blocking or permitting the flow of engine oil from the recesses by controlling the position of a spool within a valve body of a control valve in response to a signal from an engine control unit. The spool is urged in a given direction by rotary linear motion translating means which is rotated by an electric motor, preferably of the stepper motor type.

U.S. Pat. No. 5,497,738 shows a control system which eliminates the hydraulic force on one end of a spool resulting from directly applied hydraulic fluid from the engine oil gallery at full hydraulic pressure, $P_S$, utilized by previous embodiments of the VCT system. The force on the other end of the vented spool results from an electromechanical actuator, preferably of the variable force solenoid type, which acts directly upon the vented spool in response to an electronic signal issued from an engine control unit ("ECU") which monitors various engine parameters. The ECU receives signals from sensors corresponding to camshaft and crankshaft positions and utilizes this information to calculate a relative phase angle. A closed-loop feedback system which corrects for any phase angle error is preferably employed. The use of a variable force solenoid solves the problem of sluggish dynamic response. Such a device can be designed to be as fast as the mechanical response of the spool valve, and certainly much faster than the conventional (fully hydraulic) differential pressure control system. The faster response allows the use of increased closed-loop gain, making the system less sensitive to component tolerances and operating environment.

U.S. Pat. No. 5,657,725 shows a control system which utilizes engine oil pressure for actuation. The system includes A camshaft has a vane secured to an end thereof for non-oscillating rotation therewith. The camshaft also carries a housing which can rotate with the camshaft but which is oscillatable with the camshaft. The vane has opposed lobes which are received in opposed recesses, respectively, of the housing. The recesses have greater circumferential extent than the lobes to permit the vane and housing to oscillate with respect to one another, and thereby permit the camshaft to change in phase relative to a crankshaft. The camshaft tends to change direction in reaction to engine oil pressure and/or camshaft torque pulses which it experiences during its normal operation, and it is permitted to either advance or retard by selectively blocking or permitting the flow of engine oil through the return lines from the recesses by controlling the position of a spool within a spool valve body in response to a signal indicative of an engine operating condition from an engine control unit. The spool is selectively positioned by controlling hydraulic loads on its opposed end in response to a signal from an engine control unit. The vane can be biased to an extreme position to provide a counteractive force to a unidirectionally acting frictional torque experienced by the camshaft during rotation.

U.S. Pat. No. 6,247,434 shows a multi-position variable camshaft timing system actuated by engine oil. Within the system, a hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,250,265 shows a variable valve timing system with actuator locking for internal combustion engine. The system comprising a variable camshaft timing system comprising a camshaft with a vane secured to the camshaft for rotation with the camshaft but not for oscillation with respect to the camshaft. The vane has a circumferentially extended plurality of lobes projecting radially outwardly therefrom and is surrounded by an annular housing that has a corresponding plurality of recesses each of which receives one of the lobes and has a circumferential extent greater then the circumferential extent of the lobe received therein to permit oscillation of the housing relative to the vane and the camshaft while the housing rotates with the camshaft and the vane. Oscillation of the housing relative to the vane and the camshaft is actuated by pressurized engine oil in each of the recesses on opposed sides of the lobe therein, the oil pressure in such recess being preferably derived in part from a torque pulse in the camshaft as it rotates during its operation. An annular locking plate is positioned coaxially with the camshaft and the annular housing and is moveable relative to the annular housing along a longitudinal central axis of the camshaft between a first position, where the locking plate engages the annular housing to prevent its circumferential movement relative to the vane and a second position where circumferential movement of the annular housing relative to the vane is permitted. The locking plate is biased by a spring toward its first position and is urged away from its first position toward its second position by engine oil pressure, to which it is exposed by a passage leading through the camshaft, when engine oil pressure is sufficiently high to overcome the spring biasing force, which is the only time when it is desired to change the relative positions of the annular housing and the vane. The movement of the locking plate is controlled by an engine electronic control unit either through a closed loop system or an open loop control system.

U.S. Pat. No. 6,263,846 shows a control valve strategy for a vane-type variable camshaft timing system. The strategy involves an internal combustion engine that include a camshaft and hub secured to the camshaft for rotation therewith, where a housing circumscribes the hub and is rotatable with the hub and the camshaft, and is further oscillatable with respect to the hub and camshaft. Driving vanes are radially inwardly disposed in the housing and cooperate with the hub, while driven vanes are radially outwardly disposed in the hub to cooperate with the housing and also circumferentially alternate with the driving vanes to define circumferentially alternating advance and retard chambers. A configuration for controlling the oscillation of the housing relative to the hub includes an electronic control unit, and an advancing control valve that is responsive to the electronic engine control unit and that regulates engine oil pressure to and from the advance chambers. A retarding control valve responsive to the electronic engine control unit regulates engine oil pressure to and from the retard chambers. An advancing passage communicates engine oil pressure between the advancing control valve and the advance chambers, while a retarding passage communicates engine oil pressure between the retarding control valve and the retard chambers.

U.S. Pat. No. 6,311,655 shows multi-position variable cam timing system having a vane-mounted locking-piston device. An internal combustion engine having a camshaft and variable camshaft timing system, wherein a rotor is secured to the camshaft and is rotatable but non-oscillatable with respect to the camshaft is discribed. A housing circumscribes the rotor, is rotatable with both the rotor and the camshaft, and is further oscillatable with respect to both the rotor and the camshaft between a fully retarded position and a fully advanced position. A locking configuration prevents relative motion between the rotor and the housing, and is mounted within either the rotor or the housing, and is respectively and releasably engageable with the other of either the rotor and the housing in the fully retarded position, the fully advanced position, and in positions therebetween. The locking device includes a locking piston having keys terminating one end thereof, and serrations mounted opposite the keys on the locking piston for interlocking the rotor to the housing. A controlling configuration controls oscillation of the rotor relative to the housing.

U.S. Pat. No. 6,374,787 shows a multi-position variable camshaft timing system actuated by engine oil pressure. A hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

It has became more common for variable camshaft timing mechanisms to be made in a vane/housing format. Working hydraulic chambers are created by imposing either single or multiple vanes of a rotor attached to the camshaft into a cavity in a housing that is attached to the camshaft sprocket. The circumferential length of the pocket or cavity in the housing determines the relative phase travel of the camshaft relative to the sprocket/housing. The control is accomplished by exhausting fluid such as oil from one chamber while simultaneously filling the opposing chamber. This causes the variable camshaft timing mechanism to move the camshaft relative to the crankshaft manifested in a phase position.

The rate of change of the camshaft is determined in part by how fast the oil can exhaust from the resisting or draining hydraulic chamber. As the rotor of the VCT reaches the end of its travel limited by the cavity of the housing, the rotor will impact the housing and cause undesirable noise. As can be seen, there is need in a phaser to reduce the noise at the end of travel and keeping suitable rate of change in the phase position of the camshaft.

SUMMARY OF THE INVENTION

A vane type phaser is provided to reduce noise at the end of travel of a rotor with a phaser housing.

A vane type phaser is provided to reduce noise at the end of travel of a rotor with a phaser housing, where maintaining suitable rate of change.

A vane type phaser is provided to reduce noise at the end of travel of a rotor with a phaser housing by allowing fluid therein to travel normally from hydraulic chamber, thereby not limiting the actuation rate of the VCT system.

A vane type phaser is provided to reduce noise at the end of travel of a rotor with a phaser housing having a chamber, wherein inlet fluid and exhaust port for the same are separated.

Accordingly, a phaser having a hydraulic cushioning mechanism is provided. The phaser includes: a) a housing having at least one cavity; and b) a rotor disposed to move relative to the housing. The rotor includes at least one vane to each cavity, each vane being an extension of the rotor and disposed to oscillate within the cavity, wherein the vane divides the cavity into a first chamber and a second chamber; at least one passage facilitating fluid communication between the first chamber and the second chamber, the passage having a first port for leading fluid into and out of the first chamber and a second port for leading fluid into and out of the second chamber; and at least one distance defined by a first terminal point and a second terminal point, the first terminal point being in the close proximity of the vane as well as in the close proximity the rotor, and the second terminal point being only in the close proximity of the rotor and at the distance to the rotor, second terminal point being in close proximity to the first port.

Accordingly, a phaser having a hydraulic cushioning mechanism is provided. The phaser includes: a) a housing having at least one cavity; and b) a rotor disposed to move relative to the housing. The rotor includes at least one vane to each cavity, each vane being an extension of the rotor and disposed to oscillate within the cavity, wherein the vane divides the cavity into a first chamber and a second chamber; at least one passage facilitating fluid communication between the first chamber and the second chamber, the passage having a first port for leading fluid out of the first chamber and a second port for leading fluid out of the second chamber; at least one distance defined by a first terminal point and a second terminal point, the first terminal point being in the close proximity of the vane as well as in the close proximity the rotor, and the second terminal point being only in the close proximity of the rotor and at the distance to the rotor, second terminal point being in close proximity to the first port; and a separate inlet passage disposed in part within the vane portion to allow fluid inflow to the first chamber and the second chamber permitting separate inlet fluid flow into the first chamber or the second chamber, thereby the at least one passage is used only for outlet fluid.

Accordingly, a method for making a phaser having a hydraulic cushioning mechanism is provided. The method includes the steps of: a) providing a housing having at least one cavity; b) providing a rotor disposed to move relative to the housing. The rotor includes: at least one vane to each cavity, each vane being an extension of the rotor and disposed to oscillate within the cavity, wherein the vane divides the cavity into a first chamber and a second chamber; at least one passage facilitating fluid communication between the first chamber and the second chamber, the passage having a first port for leading fluid out of the first chamber and a second port for leading fluid out of the second chamber; at least one distance defined by a first terminal point and a second terminal point, the first terminal point being in the close proximity of the vane as well as in the close proximity the rotor, and the second terminal point being only in the close proximity of the rotor and at the distance to the rotor, second terminal point being in close proximity to the first port; and a separate inlet passage disposed in part within the vane leading to the first chamber and the second chamber permitting separate inlet fluid flow into the first chamber or the second chamber, thereby the at least one passage is used only for outlet fluid flow.

DETAILED DESCRIPTION OF THE INVENTION

Figure 1:
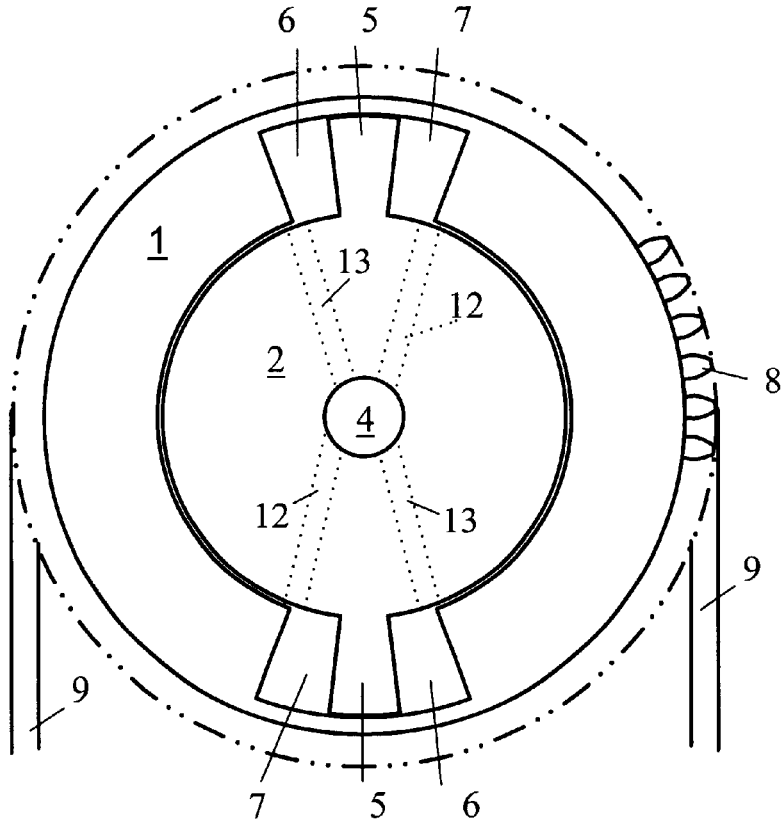
FIG. 1 shows a vane-type VCT phaser.

Referring to FIG. 1, a vane-type VCT phaser comprises a housing (1), the outside of which has sprocket teeth (8) which mesh with and are driven by timing chain (9). Inside the housing (1), a cavity including fluid chambers (6) and (7) is defined. Coaxially within the housing (1), free to rotate relative to the housing, is a rotor (2) with vanes (5) which fit between the chambers (6) and (7), and a central control valve (4) which routes pressurized oil via passages (12) and (13) to chambers (6) and (7), respectively. Pressurized oil introduced by valve (4) into passages (12) will push vanes (5) counterclockwise relative to the housing (1), forcing oil out of chambers (6) into passages (13) and into valve (4). It will be recognized by one skilled in the art that this description is common to vane phasers in general, and the specific arrangement of vanes, chambers, passages and valves shown in FIG. 1 may be varied within the teachings of the invention. For example, the number of vanes and their location can be changed, some phasers have only a single vane, others as many as a dozen, and the vanes might be located on the housing and reciprocate within chambers on the rotor. The housing might be driven by a chain or belt or gears, and the sprocket teeth might be gear teeth or a toothed pulley for a belt.

Figure 2A:
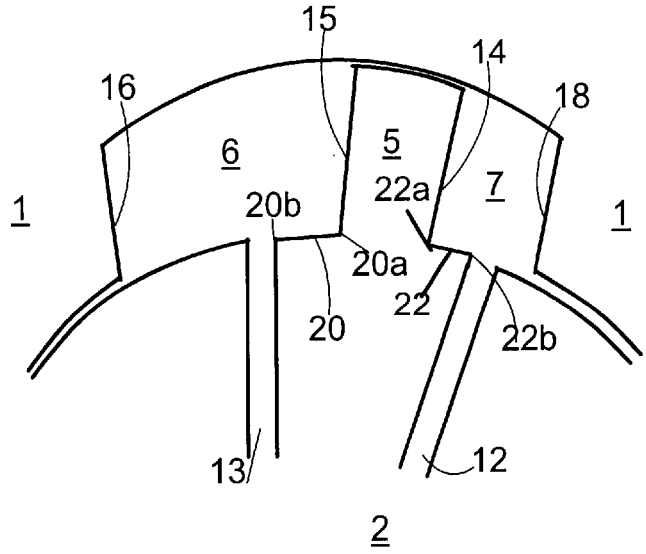
FIG. 2A shows one aspect an embodiment of the present invention.

Referring to FIG. 2*a,* in the invention, a detailed description of passage (12) and (13) to chambers (6) and (7) is shown. Vane (5) has a first wall (15) and a second wall (14) on its first side and its opposing second side respectively. When vane (5) oscillates within the cavity comprising the chambers (6) and (7), the movement thereof is stopped by the physical limitations of the housing (1). Specifically, the physical limitations to the movement of vane (5) are a first chamber wall (16) in fluid chamber (6) and an opposing second chamber wall (18) in fluid chamber (7).

As described in the Background section (supra) of the present application, undesirable noise occurs when vane (5) comes in contact with housing (1). By way of a specific example, when second wall (14) of vane (5) is stopped by second chamber wall (18), noise occurs. Similarly, when first wall (15) of vane (5) is stopped by first chamber wall (16), undesirable noise is generated as well.

The present invention introduces structures that impede the impact of vane (5) movement within the cavity of housing (1). The structure includes introducing a first distance (20) and a second distance (22) at each side of vane (5) on rotor (2). Distance (20) is defined by two terminal points, first terminal point (20*a*) and second terminal point (20*b*) respectively. Similarly, distance (22) is defined by two terminal points, first terminal point (22*a*) and second terminal point (22*b*) respectively. First terminal points (20*a,* 22*a*) can be considered as located both within vane (5) and rotor (2) with vane (5) being an extension of the rotor (2). In other words, within a neighborhood or close proximity of points (20*a,* 22*a*), there are at least one point defined on vane (5) and at least one point defined on rotor (2). Second terminal points (20*b,* 22*b*) are only located in rotor (2) portion are at distances (20, 22) respectively to vane (5). Further, second terminal points (20*b,* 22*b*) terminate at the openings or ports of passages (12) and (13) respectively at locations wherein passages (12) and (13) end or terminate at the cavity of housing (1).

The lengths or dimension of distances (20, 22) are determined by design choices. Further, the length and shape of distances (20, 22) may be identical or different. However, distances (20, 22) must satisfy one limitation which is, being part of rotor (2), they must rotate past the cavity portions of housing (1) on each side of the cavity respectively. By way of example, the distances (20, 22) may be a line segment or an arc of the circumference of the rotor (2). By way of example, point (20*b*) needs to rotate past wall (16).

Figure 2B:
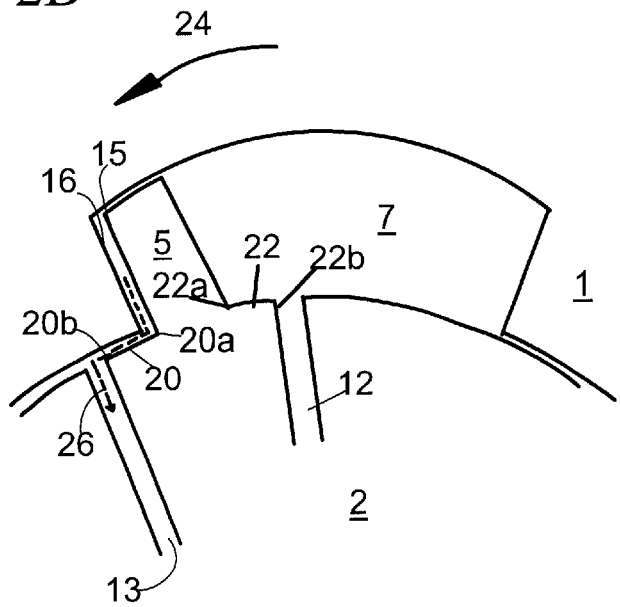
FIG. 2B shows another aspect of the embodiment of the present invention.

Referring to FIG. 2B, the process the exhausts the fluid of chamber (6) of the present invention is described. Direction (24) indicates the rotating movement of rotor (2) in relation to housing (1) with rotor (2) having vanes rigidly attached thereto (only one shown, i.e. vane (5)). The fluid in chamber (6) is exhausted normally from the hydraulic chamber (6) and simultaneously into chamber (7) according to normal phasing operation. The flow operates in such a way that actuation rate of the VCT during normal phasing operation is not disturbed until the rotor (2) nears or is in the proximity of the end of its travel. At this point the flow of fluid (26) at exhaust port in the proximity of second terminal point (20*b*) would be restricted by a close clearance defined between rotor (2) and housing (1). Therefore the relative motion or rotation between rotor (2) and housing (1) is gradually decelerated. Eventually the VCT rotor (2) will come to a stop and thus limit the impact energy with which the rotor (2) impacts the housing (1).

It is noted that the present invention contemplates application in any type VCT mechanism including Cam Torque Actuated (CTA), or oil pressure actuated mechanisms.

It is further noted that normal phasing operation is defined as the rate of change of the cam shaft when passages are fully within the cavity of the housing (1).

Figure 3:
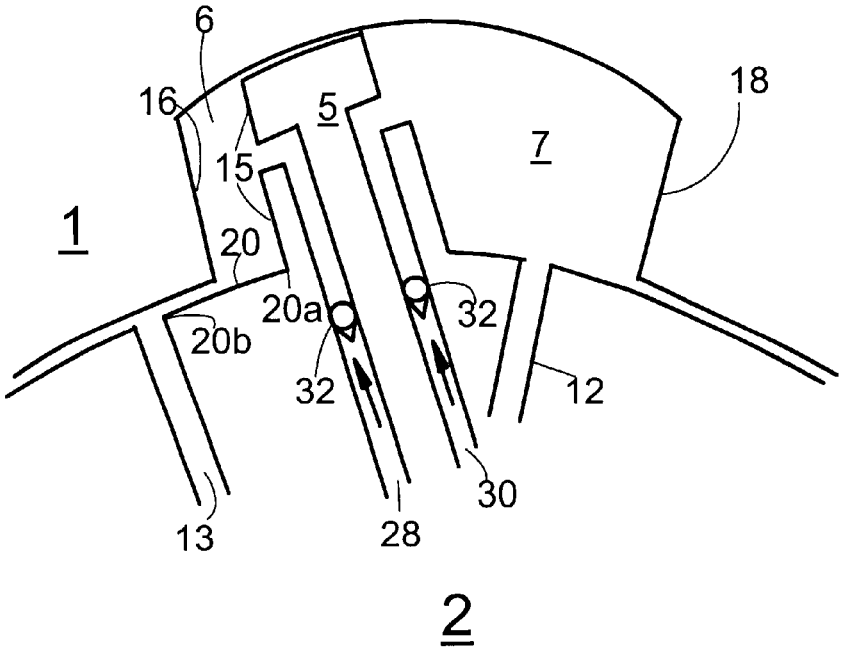
FIG. 3 shows an alternative embodiment of the present invention.

Referring to FIG. 3, another embodiment of the present invention is shown. A pair of separate inlet sources (28, 30) is introduced each with a check valve (32) and a separate exhaust ports (12, 13) respectively. As can be seen, the phaser of VCT system would have an unlimited supply of fluid to fill the chambers (6,7) and their respective exhaust ports (12, 13) thereby limiting the velocity of the rotor (2) near the end of travel. Thus good VCT response in all directions is achieved while limiting the velocity and thus the impact energy as the vane (5) approaches its mechanical stops due to the physical limitations of the housing cavity.

As discussed supra, the rate of change of the camshaft is determined, in part, by how fast fluid can exhaust from the resisting hydraulic chamber. As the rotor (2) of the VCT reaches the end of its travel, as limited by the housing (1), the rotor (2) will impact the housing (1) and cause undesirable noise. The present invention permits the fluid to exhaust normally from the hydraulic chamber and thus does not limit the actuation rate of the VCT during normal phasing until the rotor nears the end of its travel. At this point the exhaust port would be restricted by the close clearance between the rotor (2) and the housing (1) by the provision of the distances (20, 22) at each end of the housing cavity respectively. In order to facilitate the normal fluid flow, separate inlet passages (28, 30) cures the possible defect of insufficient flow out of the exhaust chamber to the inlet chamber (see FIG. 3). Without the separate inlet passage, fluid might not be exhausted sufficiently during the end of travel time segments. The end result may be insufficient fluid flow out of the exhaust chamber into the opposite chamber. However, the vane still moves in that the volume of the opposite chamber is increasing. This increase may cause the opposite chamber to draw undesirable material such as ambient air around the phaser.

The present invention gradually decelerates the VCT rotor (2) to a stop, thus limiting the impact energy with which the rotor (2) impacts the housing (1). The present invention contemplates application in any type VCT mechanism.

An improvement on the structure described supra would be to separate the inlet fluid and the exhaust port in each hydraulic chamber as shown in FIG. 2B. Once the rotor (2) reaches its end of travel, it not only restricts fluid leaving the exhaust hydraulic chamber but it could restrict the oil entering the inlet hydraulic chamber as well. This could cause a delay in actuation of the VCT mechanism in the opposite direction. However, if a separate inlet source is introduced with a check valve and a separate exhaust port is used as shown in FIG. 3, then the VCT has an unlimited supply of fluid to fill the chamber and an exhaust port that limited the velocity of the rotor near the end of travel. This would give the VCT good response in all phaser directions while limiting the velocity and thus the impact energy when it approaches the mechanical stops.

For example, in FIG. 3 when fluid is exhausting from chamber (6) via passage (13), at the end of travel of vane (5)

the fluid flow rate may be decreased due to the structure of the present invention. At this juncture, chamber (7) still needs to be filled with sufficient fluid flow of a suitable rate. If the flow is below a threshold value, undesirable effects including entry of ambient air may get into chamber (7). The introduction of inflow passage (30) reduces or solves the undesirable effect problem by introducing sufficient fluid flow rate thereby resulting in sufficient fluid flow into chamber (7). Similar results occur at the opposite end of travel of the vane.

It is noted that only a portion of the phaser is shown here. The phaser may have more than one similar structure as shown in FIGS. 2A, 2B, or 3. For example, the phaser may have 2, 4, or 8 similar structures.

Figure 4:
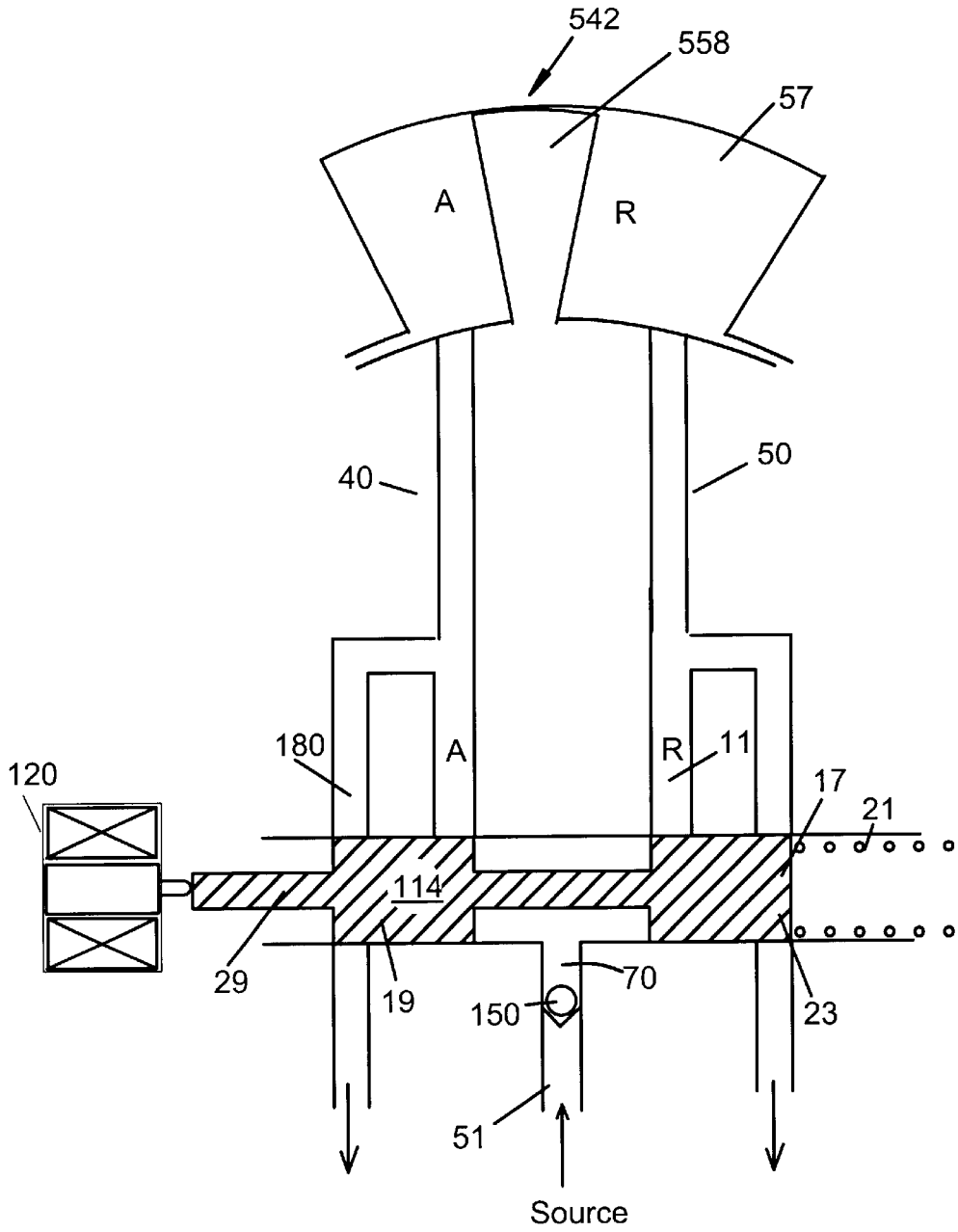
FIG. 4 shows VCT system suitable for the present invention.

FIG. 4 is a schematic depiction that shows, in part, the VCT system of the present invention. A null position is shown in FIG. 4. Solenoid (120) engages spool valve (114) by exerting a first force upon the same on a first end (29). The first force is met by a force of equal strength exerted by spring (21) upon a second end (17) of spool valve 114 thereby maintaining the null position. The spool valve (114) includes a first block (19) and a second block (23) each of which blocks fluid flow respectively.

The phaser (542) includes a vane (558), a housing (57) using the vane (558) to delimit an advance chamber A and a retard chamber R therein. Typically, the housing (57) and the vane (558) are coupled to crank shaft (not shown) and cam shaft (also not shown) respectively. Vane (558) is permitted to move relative to the phaser housing by adjusting the fluid quantity of advance and retard chambers A and R. If it is desirous to move vane (558) toward the retard side, solenoid (120) pushes spool valve (114) further right from the original null position such that liquid in chamber A drains out along duct (40) through duct (180). The fluid further flows or is in fluid communication with an outside sink (not shown) by means of having block (19) sliding further right to allow said fluid communication to occur. Simultaneously, fluid from a source passes through duct (51) and is in one-way fluid communication with duct (70) by means of one-way valve (150), thereby supplying fluid to chamber R via duct (50). This can occur because block (23) moved further right causing the above one-way fluid communication to occur. When the desired vane position is reached, the spool valve is commanded to move back left to its null position, thereby maintaining a new phase relationship of the crank and cam shaft.

Figure 5:
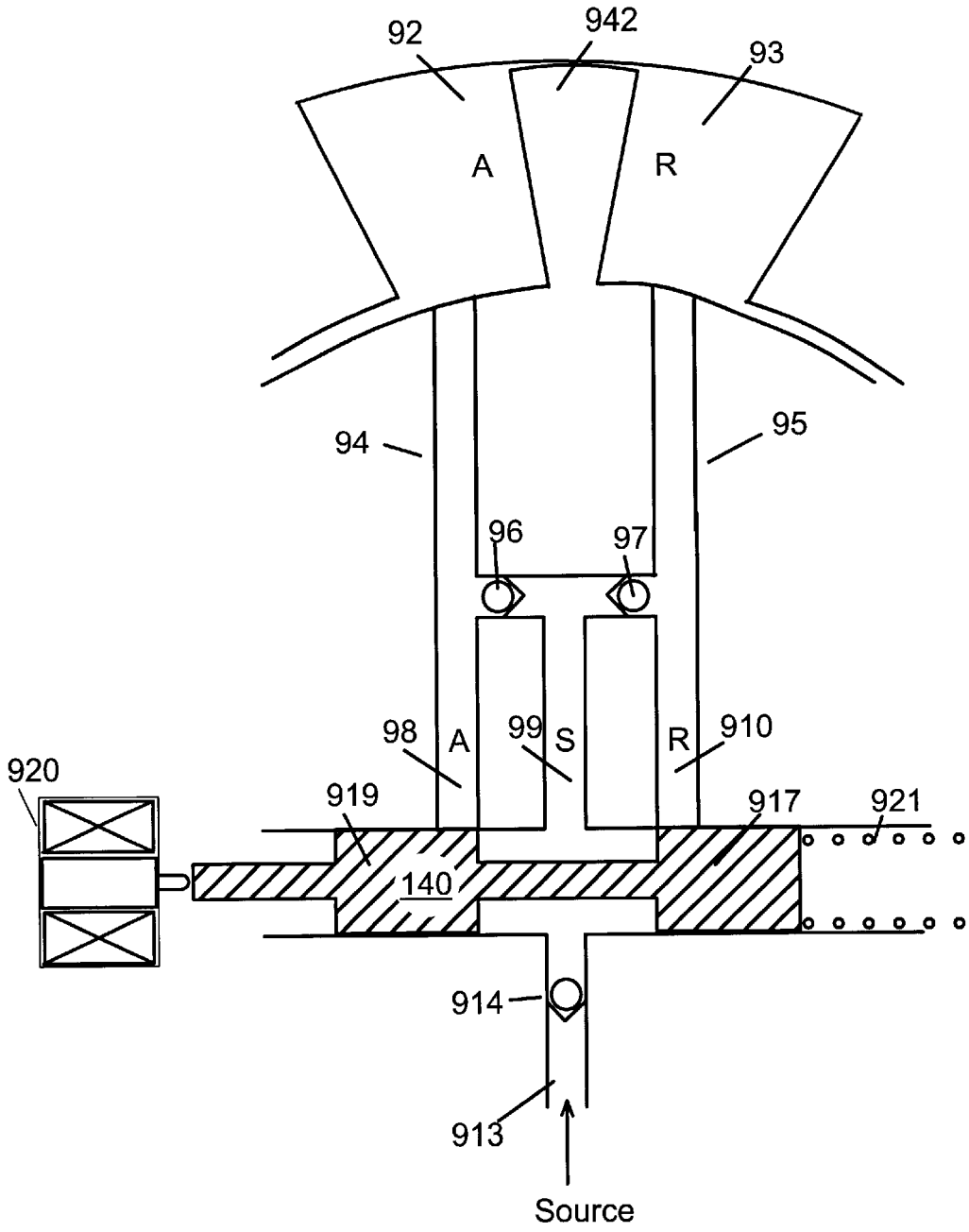
FIG. 5 shows a Cam Torque Actuated (CTA) VCT system applicable to the present invention.

Referring to FIG. 5, a Cam Torque Actuated (CTA) VCT system applicable to the present invention is shown. The CTA system uses torque reversals in camshaft caused by the forces of opening and closing engine valves to move vane (942). The control valve in a CTA system allows fluid flow from advance chamber (92) to retard chamber (93) or vice versa, allowing vane (942) to move, or stops fluid flow, locking vane (942) in position. CTA phaser may also have oil input (913) to make up for losses due to leakage, but does not use engine oil pressure to move phaser.

The detailed operation of CTA phaser system is as follows. FIG. 5 depicts a null position in that ideally no fluid flow occurs because the spool valve (140) stops fluid circulation at both advance end (98) and retard end (910). When cam angular relationship is required to be changed, vane (942) necessarily needs to move. Solenoid (920), which engages spool valve (140), is commanded to move spool (140) away from the null position thereby causing fluid within the CTA circulation to flow. It is pointed out that the CTA circulation ideally uses only local fluid without any fluid coming from source (913). However, during normal operation, some fluid leakage occurs and the fluid deficit needs to be replenished by the source (913) via a one way valve (914). The fluid in this case may be engine oil. The source (913) may be the oil pan.

There are two scenarios for the CTA phaser system. First, there is the Advance scenario, wherein an Advance chamber (92) needs to be filled with more fluid than in the null position. In other words, the size or volume of chamber (92) is increased. The advance scenario is accomplished by way of the following.

Solenoid (920) pushes the spool valve (140) toward right such that the left portion (919) of the spool valve (140) still stops fluid flow at the advance end (98). But simultaneously the right portion (917) moved further right leaving retard portion (910) in fluid communication with duct (99). Because of the inherent torque reversals in camshaft, drained fluid from the retard chamber (93) feeds the same into advance chamber (92) via one-way valve (96) and duct (94).

Similarly, for the second scenario which is the retard scenario wherein a Retard chamber (93) needs to be filled with more fluid than in the null position. In other words, the size or volume of chamber (93) is increased. The retard scenario is accomplished by way of the following.

Solenoid (920) reduces its engaging force with the spool valve (140) such that an elastic member (921) forces spool (140) to move left. The right portion (920) of the spool valve (140) stops fluid flow at the retard end (910). But simultaneously the left portion (919) moves further left leaving Advance portion (98) in fluid communication with duct (99). Because of the inherent torque reversals in camshaft, drained fluid from the Advance chamber (92) feeds the same into Retard chamber (93) via one-way valve (97) and duct (95).

As can be appreciated, with the CTA cam phaser, the inherent cam torque energy is used as the motive force to re-circulate oil between the chambers (92, 93) in the phaser. This varying cam torque arises from alternately compressing, then releasing, each valve spring, as the camshaft rotates.

It should be noted that FIGS. 4 and 5 are used to show different types of VCT system suitable for the present invention. Some structures are not depicted in detail. For these details, refer to FIGS. 2–3.

The following are terms and concepts relating to the present invention.

It is noted the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA)_VCT system in which a VCT system that uses torque reversals in camshaft caused by the forces of opening and closing engine valves to move the vane. The control valve in a CTA system allows fluid flow from advance chamber to retard chamber, allowing vane to move, or stops flow, locking vane in position. The CTA phaser may also have oil input to make up for losses due to leakage, but does not use engine oil pressure to move phaser. A vane is a radial element actuating fluid acts upon, housed in chamber. A vane phaser is a phaser which is actuated by vanes moving in chambers.

There may be one or more camshaft per engine. The camshaft may be driven by a belt or chain or gears or another camshaft. Lobes may exist on camshaft to push on valves. In a multiple camshaft engine, most often has one shaft for exhaust valves, one shaft for intake valves. A "V" type engine usually has two camshafts (one for each bank) or four (intake and exhaust for each bank).

A chamber or cavity is defined as a space within which vane rotates. The chamber may be divided into advance chamber (makes valves open sooner relative to crankshaft) and retard chamber (makes valves open later relative to crankshaft). A check valve is defined as a valve which permits fluid flow in only one direction. A closed loop is defined as a control system which changes one characteristic in response to another, then checks to see if the change was made correctly and adjusts the action to achieve the desired result (e.g. moves a valve to change phaser position in response to a command from the ECU, then checks the actual phaser position and moves valve again to correct position). The control valve is a valve which controls flow of fluid to phaser. The control valve may exist within the phaser in CTA system. The control valve may be actuated by oil pressure or a solenoid. Crankshaft takes power from pistons and drives transmission and camshaft. Spool valve is defined as the control valve of spool type. Typically the spool rides in bore, connects one passage to another. Most often the spool is most often located on center axis of rotor of a phaser.

A differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure), full supply pressure is supplied to the other end of the spool (hence differential pressure). The valve Control Unit (VCU) is a control circuitry for controlling the VCT system. Typically the VCU acts in response to commands from ECU.

A driven shaft is any shaft which receives power (in VCT, most often camshaft). Driving shaft is any shaft which supplies power (in VCT, most often crankshaft, but could drive one camshaft from another camshaft). ECU is an Engine Control Unit that is the car's computer. Engine Oil is the oil used to lubricate engine, pressure can be tapped to actuate phaser through control valve.

The housing is defined as the outer part of phaser with chambers. The outside of housing can be pulley (for timing belt), sprocket (for timing chain) or gear (for timing gear). Hydraulic fluid is any special kind of oil used in hydraulic cylinders, similar to brake fluid or power steering fluid. Hydraulic fluid is not necessarily the same as engine oil. Typically the present invention uses "actuating fluid". The lock pin is disposed to lock a phaser in position. Usually the lock pin is used when oil pressure is too low to hold phaser, as during engine start or shutdown.

An oil Pressure Actuated (OPA) VCT system uses a conventional phaser, where engine oil pressure is applied to one side of the vane or the other to move the vane.

An open loop is used in a control system which changes one characteristic in response to another (say, moves a valve in response to a command from the ECU) without feedback to confirm the action.

Phase is defined as the relative angular position of camshaft and crankshaft (or camshaft and another camshaft, if phaser is driven by another cam). A phaser is defined as the entire part which mounts to cam. The phaser is typically made up of rotor and housing and possibly spool valve and check valves. A piston phaser is a phaser actuated by pistons in cylinders of an internal combustion engine. The rotor is the inner part of the phaser, which is attached to a cam shaft.

Pulse-width Modulation (PWM) provides a varying force or pressure by changing the timing of on/off pulses of voltage or fluid pressure. The solenoid is an electrical actuator which uses electrical current flowing in coil to move a mechanical arm. A variable force solenoid (VFS) is a solenoid whose actuating force can be varied, usually by PWM of supply voltage or with a current controller. A VFS is an alternative to an on/off (all or nothing) solenoid.

The sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

A Torsion Assist (TA) or Torque Assisted phaser is a variation on the OPA phaser, which adds a check valve in the oil supply line (i.e. a single check valve embodiment) or a check valve in the supply line to each chamber (i.e. two check valve embodiment). The check valve blocks oil pressure pulses due to torque reversals from propagating back into the oil system, and stop the vane from moving backward due to torque reversals. In the TA system, motion of the vane due to forward torque effects is permitted; hence the expression "torsion assist" is used. Graph of vane movement is step function.

A VCT system includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between cam and the crankshafts, in which the crank shaft is connected to the pistons.

Variable Valve Timing (VVT) is any process which changes the valve timing. VVT could be associated with VCT, or could be achieved by varying the shape of the cam or the relationship of cam lobes to cam or valve actuators to cam or valves, or by individually controlling the valves themselves using electrical or hydraulic actuators. In other words, all VCT is VVT, but not all VVT is VCT.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A phaser having a hydraulic cushioning mechanism, comprising:

a) a housing (1) having at least one cavity defined by an arcuate outer wall, a first side wall (16), and a second side wall (18); and b) a rotor (2) disposed to move relative to the housing (1), the rotor (2) including a hub;

at least one vane (5) to each cavity, each vane (5) extending from a base at the hub to the outer wall of the cavity, wherein the vane (5) divides the cavity into a first chamber (6) and a second chamber (7); and a first passage (13) facilitating fluid communication to a first port in the first chamber (6) and a second passage (12) facilitating fluid communication to a second port in the second chamber (7), each port being spaced apart from the base of the vane such that, when the vane is rotated in the cavity towards the first side wall or the second side wall, the housing blocks fluid flow from the cavity through the first port or the second port before the vane comes in contact with the first side wall or the second side wall that an impact of the vane with the first side wall or the second side wall is cushioned by fluid trapped between the vane and the first side wall or the second side wall; and a separate inlet passage (28, 30) disposed in part within the vane (5) to allow fluid into the first chamber (6) and the second chamber (7) permitting separate inlet fluid flow into the first chamber (6) or the second chamber (7), thereby the first passage (13) and the second passage (12) are used only for outlet fluid flow.

2. The phaser of claim 1, wherein the rotor (2) and the housing have an identical axis of rotation, and the relative movement between the housing (1) and the rotor (2) is a rotation corresponding to the axis of rotation.

3. A method for making a phaser having a hydraulic cushioning mechanism comprising the steps of:

a) providing a housing (1) having at least one cavity defined by an arcuate outer wall, a first side wall (16) and a second side wall (18); and b) providing a rotor (2) disposed to move relative to housing (1), the rotor (2) including:

a hub;

at least one vane (5) to each cavity, each vane (5) extending from a base at the hub to the outer wall of the cavity, wherein the vane (5) divides the cavity into a first chamber (6) and a second chamber (7);

a first passage (13) facilitating fluid communication to a first port in the first chamber (6) and a second passage (12) facilitating fluid communication to a second port in the second chamber (7), the passage (12, 13) having a first port for leading fluid out of the first chamber (6) and a second port for leading fluid out of the second chamber (7), each port being spaced apart from the base of the vane such that, when the vane is rotated in the cavity towards the first side wall or the second side wall, the housing blocks fluid flow from the cavity through the first port or the second port before the vane comes in contact with the first side wall or the second side wall such that an impact of the vane with the first side wall or the second side wall is cushioned by fluid trapped between the vane and the first side wall or the second side wall; and a separate inlet passage (28, 30) disposed in part within the vane (5) to allow fluid into the first chamber (6) and the second chamber (7) permitting separate inlet fluid flow into the first chamber (6) or the second chamber (7), thereby the first passage (13) and the second-passage (12) are used only for outlet fluid flow.

* * * * *

UNITED STATES PATENT AND TRADEMARK OFFICE

CERTIFICATE OF CORRECTION

PATENT NO. : 6,866,013 B2
DATED : March 15, 2005
INVENTOR(S) : Franklin R. Smith It is certified that error appears in the above-identified patent and that said Letters Patent is hereby corrected as shown below:

Title page,
Item [73], Assignee, should read -- BorgWarner Inc., Auburn Hills, MI (US) --

Signed and Sealed this

Twenty-eighth Day of June, 2005

JON W. DUDAS
*Director of the United States Patent and Trademark Office*